US005170970A

United States Patent [19]

Ballinger

[11] Patent Number: 5,170,970

[45] Date of Patent: Dec. 15, 1992

[54] METHOD AND APPARATUS FOR IMPROVING RAIL SHUNTS

[75] Inventor: Forrest H. Ballinger, Grain Valley, Mo.

[73] Assignee: Harmon Industries, Inc., Blue Springs, Mo.

[21] Appl. No.: 586,444

[22] Filed: Sep. 21, 1990

[51] Int. Cl.[5] ..... B61L 3/10

[52] U.S. Cl. ..... 246/34 R; 246/126; 246/128

[58] Field of Search ..... 246/34 R, 34 A, 34 C, 246/34 D, 34 CT, 40, 122 R, 125, 126, 128, 129, 167 R, 246, 249, 254, 255

[56] References Cited

U.S. PATENT DOCUMENTS

| | | | |
|---|---|---|---|
| 3,622,110 | 11/1971 | Campbell | 246/125 X |
| 3,706,098 | 12/1972 | Geiger | 246/125 X |
| 3,777,139 | 12/1973 | Peel | 246/125 |
| 3,944,173 | 3/1976 | Moe et al. | 246/128 X |
| 3,977,634 | 8/1976 | Smith | 246/125 X |
| 4,062,294 | 12/1977 | Cohen | 246/34 R X |
| 4,307,860 | 12/1981 | Kuhn | 246/125 X |
| 4,581,700 | 4/1986 | Farnham et al. | 246/122 R X |
| 4,745,262 | 5/1988 | Larsen | 219/492 |
| 4,868,538 | 9/1989 | Ballinger et al. | 246/125 X |
| 4,979,392 | 12/1990 | Guinon | 246/34 R X |

*Primary Examiner*—Michael S. Huppert
*Assistant Examiner*—Scott L. Lowe
*Attorney, Agent, or Firm*—Chase & Yakimo

[57] ABSTRACT

A reliable and consistent electrical contact path between the rails of a railroad track established by the shunting effect of the wheels and axles of a train is ensured by applying an alternating current signal to the rails at a voltage level sufficient to overcome poor wheel/rail contact and cause a wetting current to flow between the rails. This likewise provides a current path for railroad control and communication signals, such as the island circuit signal of a grade crossing warning system. The effective range of the wetting current signal is limited by providing the signal with a frequency of 10 KHz or higher to inductively isolate the signal source and associated stretch of track from any shunts beyond that stretch. To avoid interference with other types of electronic track equipment, the signal is applied only when required. In grade crossing warning systems, it is controlled in a fail-safe manner.

8 Claims, 1 Drawing Sheet

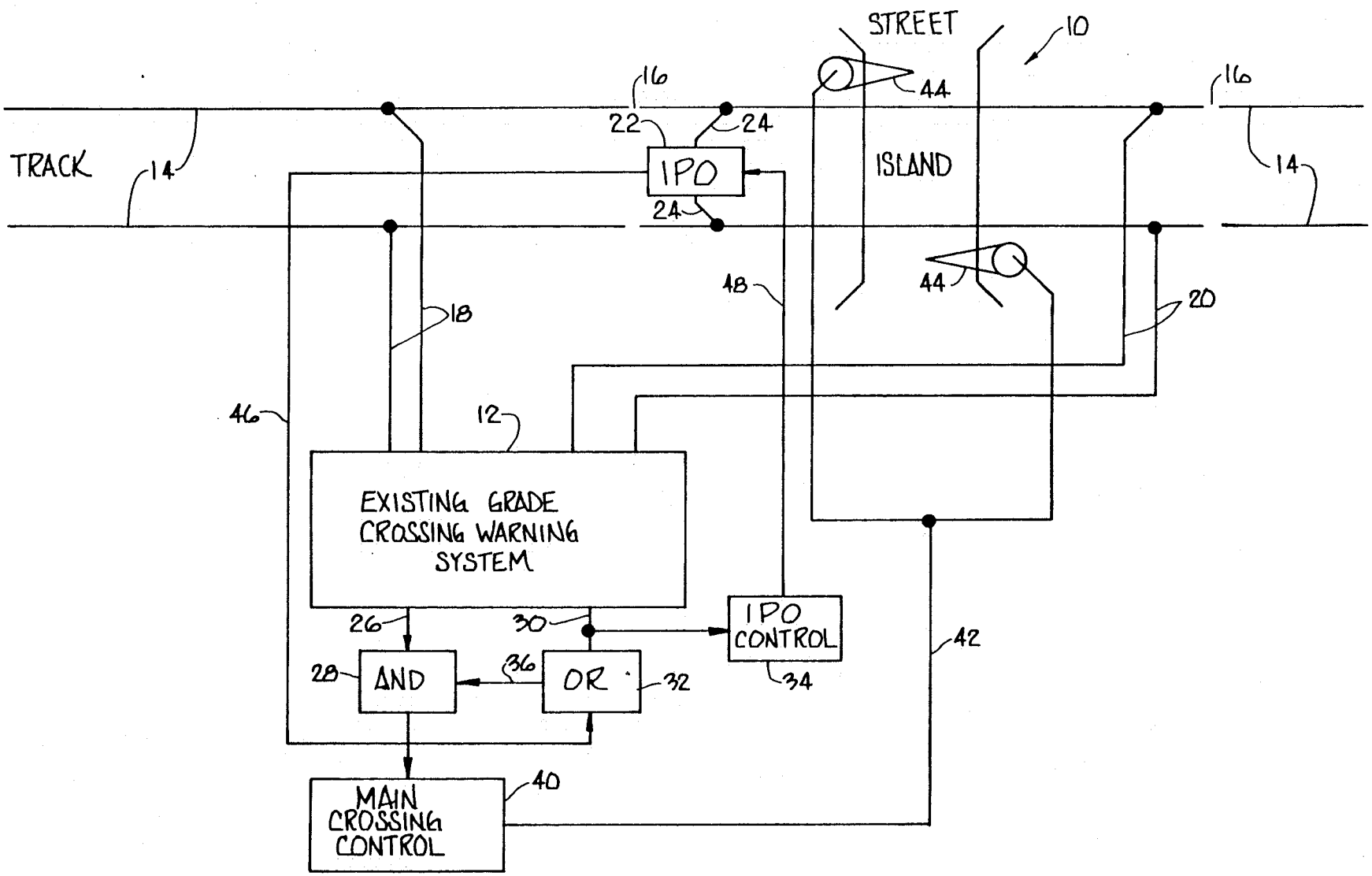
STREET
ISLAND
TRACK
IPO
IPO CONTROL
EXISTING GRADE CROSSING WARNING SYSTEM
OR
AND
MAIN CROSSING CONTROL
10
12
14
16
18
20
22
24
26
28
30
32
34
36
40
42
44
46
48

METHOD AND APPARATUS FOR IMPROVING RAIL SHUNTS

This invention relates to a method and apparatus for improving the electrical contact between a wheel of a railroad train and the rail over which the wheel travels and, in particular, to the utilization of an alternating current electrical signal which is applied to the rails to overcome poor electrical contact with the wheels by causing a wetting current to flow between the rails, and which is limited in effective range to a localized stretch of track.

The moving shunt effect caused by the metallic wheels and axles of a railroad train is an important characteristic which is relied upon in the design and practical utilization of both control and communication systems for railroads. Since the shunt is a short circuit across the rails where a train is located, the change in track impedance as seen from a protected grade crossing is used to detect the motion of the train at a distance from the crossing and predict when the train will arrive at the crossing. Appropriate warning devices such as flashing lights and/or gates are thereby activated to warn or stop vehicular traffic. When the train reaches the island section, typically a separate island detector then assumes a presence detection function to maintain the warning system in operation during the time that the train is physically present in the island. Therefore, the effective and consistent establishment of a shunt across the rails by the wheels and axles of the train is vital to the operation of the warning system.

Other types of track circuits are also dependent upon the shunt effect. For example, cab signal systems that permit the engineer to visualize a wayside signal before it can be seen by the eye rely upon the shunt established by the wheels of the trucks of the engine. A shunt failure can interupt the cab signal display and, of course, render such systems unreliable. Accordingly, in any type of track circuit that relies upon the shunting effect of the wheels and axles of the train for its effectiveness, the establishment of a low-resistance, consistent shunt by either a moving or a stationary train is a requirement.

In recent years a number of developments have made it increasingly difficult to rely upon a consistent shunt. Changes in railhead contours caused by milling the edge of the rail (reducing the normal scrubbing between the wheel and the railhead), wheel oiling to reduce rolling friction, and articulated cars with reduced axle counts impair the establishment of a consistent shunt. Also, oxide buildup (rust) on the top of the rail reduces normal rail/wheel contact. Therefore, both physical changes and the presence of contaminates provide a potential of reducing electrical contact to the point where grade crossing warning systems, which are activated by this contact, may at times be inappropriately deactivated even though a train still occupies the island. Similarly, other track circuits are rendered unreliable and subject to false indications of an emergency or warning condition or a false indication of a breakdown if the rail/wheel electrical contact is not maintained.

It has been proposed heretofore to apply an additional alternating current signal to the track for the purpose of breaking through films and oxides which may be present in order to improve the electrical contact between the train wheels and the rails over which they travel, but little benefit has been gained because of the use of relatively low frequencies, e.g. 60 Hz. The relatively high voltage required for the signal to be effective in breaking through contaminants gave the signal an effective range of up to approximately 10,000 feet, far too great to provide the localization necessary for practical use. Furthermore, without the provision of any means of controlling the times at which the signal is present, undesirable interference was caused with various types of other electronic track equipment.

SUMMARY OF THE INVENTION

It is, therefore, the primary object of the present invention to provide a method and apparatus for ensuring that the required electrical contact between a wheel of a railroad train and the rail over which the wheel travels will be maintained so that the shunt effect of the train will be effective and consistent.

As a corollary to the foregoing object, it is an important aim of this invention to provide such a method and apparatus which utilizes a relatively high voltage, alternating current signal applied to the rails, the signal having a relatively high frequency in order to inductively isolate the signal source and the applicable stretch of track from wheel/rail contact remote therefrom that might be provided by railroad cars not connected to the train of concern.

Another important object of this invention is to provide a method and apparatus as aforesaid in whcih the applied alternating current signal has a voltage level sufficient to cause a wetting current to flow across the wheel/rail contact, thereby providing an ionized path for an island circuit signal, a cab signal or other track circuit signal.

A specific object of the present invention is to provide an alternating current signal for the above purposes having a voltage of at least approximately 8 volts r.m.s. so as to reliably break through films and oxides which may be present on the track, and having a frequency of at least approximately 10 KHz so as to inductively isolate the signal source and the affected stretch of track.

Another specific object is to provide such a method and apparatus for use at an island section to ensure proper operation of the crossing warning system, wherein application of the alternating current signal to the track is controlled in conjunction with the warning system so that the system operates in a fail-safe manner.

Still another specific object of the invention is to provide an alternating current signal source onboard the train for the purpose of ensuring a current path for track circuits to the train, wherein connections of the signal source to the rails are effected by moving contacts so that the connection points at which the signal is applied to the track advance along the track with the train.

Furthermore, it is an overall objective of this invention to provide such a method and apparatus wherein the alternating current signal is not applied to the track at times when the assurance of an effective shunt is not required, in order to prevent undesirable interference with other electronic track equipment.

These and other objects of the invention are achieved by applying an alternating current signal to the track which, in conjunction with operation of an island detection circuit, would be applied at connection points on the rails within the island section. At a level of approximately 10 volts r.m.s. the signal is sufficient to provide a wetting current by arcing through films and oxides which may be present. The ionized path thus established conducts the wetting current and also the warning system signal simultaneously thereby ensuring that the warning system signal will not be interrupted by a shunt failure.

To protect the relatively high-voltage, shunt maintaining signal from loading by shunt current paths that would be established by wheels and axles outside the island section, a frequency of 10 KHz or higher is utilized. This provides inductive isolation due to the impedance characteristic (inductive) of the track and has the effect of localizing the region of influence of the wetting current voltage. For example, assuming an island section 120 feet in length, the selection of a frequency of 11.5 KHz provides a 6 db reduction in voltage at a distance of 64 feet from the point at which the voltage is applied to the track.

The wetting current voltage is provided by a power oscillator which is controlled by the grade crossing warning system such that the oscillator will always be deactivated except during the time that a train is actually occupying the island section, and the island detection circuit is deenergized (indicating the presence of a train in the island). Since the oscillator is not continuously activated, proof of its proper operation is provided by the use of a fail-safe control which activates the crossing warning in the event of a malfunction.

In the utilization of the present invention in connection with cab signal systems, the oscillator is mounted in the engine of the train and connections are made to the rails by moving contacts, either brushes or carbon blocks located between the wheels of the first truck or, alternatively, between the first and second trucks. Transmission of the wetting signal down the track in front of the train is limited by the shunting effect of the lead wheels. If, for any reason, the lead wheels should fail to shunt, the high frequency limits the range in the same manner as discussed above in the application of the invention to an island section, in view of the inductive reactance of the track.

BRIEF DESCRIPTION OF THE DRAWING

The FIGURE is a block diagram illustrating the application of the teachings of the present invention to an island section at a grade crossing protected by a warning system.

DETAILED DESCRIPTION

The FIGURE illustrates a grade crossing 10 protected by a warning system 12 which includes a conventional motion detector for sensing an approaching train and an island detector circuit for maintaining the warning in an activated condition so long as the train is present in the island section of the railroad track. As schematically illustrated in the figure, the island section is an insulated track section separated from the rails 14 of the main track by insulated joints represented at 16. A pair of input leads 18 to the motion detector are connected to the rails 14 outside the island, and the island detector circuit is connected by a pair of leads 20 to corresponding rails within the island section. An island power oscillator (IPO) 22 is preferably mounted between the rails in the island section, the output thereof being directly connected to the two rails by leads 24. By mounting the power oscillator 22 between the rails, the output leads 24 are kept as short as possible.

The warning system 12 has a motion detector output 26 which is connected to one input of a fail-safe AND gate 28. The warning system 12 also has an island detector output 30 which is connected to a fail-safe OR gate 32 and a control 34 for the power oscillator. The output 36 of the OR gate 32 is directly connected to a second input of the AND gate 28. The output 38 of the AND gate is connected to a main crossing control 40 having an output connected via a line 42 to the warning devices at the crossing, illustrated in the figure by the two gates 44 shown blocking the street or roadway.

The function of the IPO control 34 is to switch the power oscillator 22 on only when a train is in the island section. The operation of the fail-safe gates assures this, and further ensures that the warning will be activated or remain activated in the event of a malfunction of the power oscillator 22.

More specifically, the motion detector output 26 and the island detector output 30 are normally at their high logic levels, indicating that a train is not approaching and that a train is not present in the island. The IPO control 34 is connected to the power oscillator 22 by a line 48 and energizes the power oscillator only when a low logic level signal is applied to its input. When the oscillator 22 is not in operation, a low logic level stands on a control lead 46 indicating the absence of an oscillator output. Lead 46 is connected to a second input of the OR gate 32. Accordingly, under conditions where no warning is necessary, the high logic level from island output 30 and the low logic level on oscillator output lead 46 maintain the output 36 of the OR gate at the high logic level. Therefore, the output 38 of the AND gate 28 is high and the main crossing control 40 does not activate the crossing warning.

When an approaching train is detected, the motion detector output 26 goes low, the AND gate output 38 goes low and the warning is activated to cause the gates 44 to be lowered into position. When the train enters the island section, the OR gate output 36 remains high because the island detector output 30 goes low, causing the power oscillator 22 to be energized and the output on lead 46 to assume the high logic level. Since output 30 goes from high to low and lead 46 goes from low to high, the OR gate output 36 is unchanged. When the train clears the crossing, the fail-safe gates will resume their normal states and the warning is deactivated.

However, should the power oscillator 22 fail to operate when the island output 30 goes to the low logic level (train present), the OR gate output 36 goes low and remains at this level because the OR gate 32 is of the type requiring a manual reset once its output goes to the low logic level. Therefore, the crossing gates 44 will remain down and the warning will thus remain activated once the train leaves the island, so that maintenance personnel must attend to the malfunction in order to deactivate the crossing warning.

In the application of the present invention to cab signal systems (not illustrated), the power oscillator is mounted in the engine of the train and each lead from the oscillator output is connected to a corresponding rail 14. Brushes or carbon blocks located between the wheels of the first truck of the engine (or between the first and second trucks) are mounted in sliding engagement with the rails 14 so that the oscillator output is continuously connected to the rails.

It has been found that an oscillator output voltage of approximately 8 volts r.m.s. is required to consistently provide the wetting current. This current provides an ionized path across the mating wheel/rail surfaces as previously described and ensures that the shunt across the rails is maintained. Higher voltages may, of course, be employed and the range controlled by the choice of oscillator frequency as will be discussed.

CHOICE OF FREQUENCY

Determination of the proper oscillator frequency for a particular application is based upon functional parameters peculiar to a railroad track. Specifically, a typical track has an inductance per foot of 0.5 microhenry, a wire inductance per foot of 1.0 microhenry, and a wire length of 5 feet. Accordingly, the inductive reactance as a function of track length may be readily ascertained. Knowing the oscillator source impedance (for example, 2 ohms), the loss in decibels along the length of the track may be calculated.

With reference to improving shunting in an island section, selection of a frequency of 11.5 KHz provides a half voltage (6 db) point at 64 feet as discussed in the summary of the invention. In the utilization of the wetting current signal to ensure the reliability of cab signal systems or other track circuits, a shorter effective range is provided by increasing the frequency (such as, for example, to 20 KHz or higher) to cause a proportionate reduction in range and, therefore, greater localization.

Having thus described the invention, what is claimed as new and desired to be secured by Letters Patent is:

1. A method of improving an electrical contact path between the rails of a railroad track through the wheels and axles of a train, said method comprising the steps of:

connecting a source of an alternating current signal to the rails at connection points in a predetermined stretch of track;

shunting across the rails in said stretch of track by contacting said wheels of a train therewith;

applying said signal to the rails at said connection points and at a voltage level sufficient to overcome poor electrical contact between each wheel and a corresponding rail and cause a wetting current to flow between the shunted rails; and providing said signal with a frequency selected to cause the signal, to have an effective range from said connection points confined to said stretch of track and inductively isolate said stretch of track from any other wheel/rail contact beyond said stretch.

2. The method as claimed in claim 1, wherein said step of connecting the signal source to the rails includes effecting the connection within an island section of the track, whereby to ensure a current path for grade crossing warning system signals.

3. The method as claimed in claim 1, further comprising the step of providing said signal source onboard the train, whereby to ensure a current path for track circuits to the train.

4. Apparatus for improving the electrical shunt across the rails of a railroad track provided by the wheels and axles of a train, said apparatus comprising:

an oscillator for producing an alternating current electrical signal, means for connecting the oscillator output to the rails at connection points in a stretch of track within which a shunt current path is to be ensured when a train is present, and said oscillator having means for providing said alternating current signal with a voltage sufficient to overcome poor electrical contact between each wheel and a corresponding rail and cause a wetting current to flow between the rails along said shunt current path, and for providing said alternating current signal with a frequency selected to cause the signal to have an effective range from said connection points confined to said stretch of track and inductively isolate said stretch of track from any wheel/rail contact beyond said stretch.

5. The apparatus as claimed in claim 4, wherein said stretch of track is an island section.

6. The apparatus as claimed in claim 5, further comprising a grade crossing warning system having an island detector which detects the presence of a train in the island section, and means responsive to said system and connected with said oscillator for disabling the latter except when a train is present in the island section.

7. The apparatus as claimed in claim 6, wherein said warning system includes means for maintaining a crossing warning in an activated condition in response to failure of said oscillator to operate when a train is present in the island section.

8. The apparatus as claimed in claim 4, wherein said oscillator is adapted to be located onboard a train, said connecting means including means for establishing moving contact with the rails at said connection points, whereby said connection points advance along the track with the train.

* * * * *